US006742342B1

(12) United States Patent
Bonaquist et al.

(10) Patent No.: US 6,742,342 B1
(45) Date of Patent: Jun. 1, 2004

(54) SYSTEM FOR COOLING A POWER TRANSFORMER

(75) Inventors: Dante Patrick Bonaquist, Grand Island, NY (US); John Henri Royal, Grand Island, NY (US); Michael James Lockett, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/436,071

(22) Filed: May 13, 2003

(51) Int. Cl.[7] ..... F17C 7/02
(52) U.S. Cl. ..... 62/52.1; 62/259.2; 62/121
(58) Field of Search ..... 62/52.1, 121, 259.2, 62/304

(56) References Cited

U.S. PATENT DOCUMENTS

| | | | | | |
|---|---|---|---|---|---|
| 4,173,746 | A | * | 11/1979 | Stubblefield et al. | 336/57 |
| 4,195,686 | A | * | 4/1980 | Pierce | 165/122 |
| 4,237,700 | A | * | 12/1980 | Rothchild | 62/51.1 |
| 4,350,838 | A | * | 9/1982 | Harrold | 174/15.1 |
| 4,512,387 | A | | 4/1985 | Rodriguez et al. | 165/1 |
| 5,261,243 | A | * | 11/1993 | Dunsmore | 62/52.1 |
| 5,438,840 | A | * | 8/1995 | Barber et al. | 62/64 |
| 5,634,355 | A | * | 6/1997 | Cheng et al. | 62/632 |
| 5,934,080 | A | | 8/1999 | Foley et al. | 62/46.1 |
| 6,044,648 | A | * | 4/2000 | Rode | 62/62 |
| 6,399,876 | B1 | | 6/2002 | Oakes | 174/15.1 |
| 2001/0032718 | A1 | | 10/2001 | Sheerin et al. | 165/130 |
| 2002/0088242 | A1 | | 7/2002 | Williams | 62/259.2 |

* cited by examiner

*Primary Examiner*—William C. Doerrler
(74) *Attorney, Agent, or Firm*—Stanley Ktorides

(57) ABSTRACT

A system for cooling a power transformer wherein cryogen in liquid or solid form is sprayed into a vaporizer or directly onto a power transformer radiator and the vaporizing and/or sublimating cryogen cools a cooling fluid within the vaporizer or cools the radiator directly to provide cooling to the power transformer.

8 Claims, 3 Drawing Sheets

SYSTEM FOR COOLING A POWER TRANSFORMER

TECHNICAL FIELD

This invention relates generally to the operation of power transformers and, more particularly, to the cooling of power transformers.

Background Art

The capacity of power transformers, such as mobile power transformers or stationary power transformers located at substations, is impacted greatly by ambient temperature. During the summer, when the demand for electric power is high, ambient temperature can limit substation capacity. Eliminating this seasonal bottleneck will be advantageous for providing uninterrupted service during peak demand periods without having to provide additional transformer capacity to handle the peak loads. While cooling of power transformers is known, conventional systems for providing cooling to power transformers has had only limited effectiveness.

Accordingly, it is an object of this invention to provide a system for cooling power transformers which can cool power transformers more effectively than can conventional power transformer cooling systems.

SUMMARY OF THE INVENTION

The above and other objects, which will become apparent to those skilled in the art upon a reading of this invention, are attained by the present invention, one aspect of which is:

A method for cooling a power transformer comprising:

(A) drawing air into a vaporizer having an intake and an exhaust, and passing air through the vaporizer from the intake to the exhaust;

(B) passing liquid cryogen from a storage vessel to the vaporizer, spraying liquid cryogen into the vaporizer, and cooling air within the vaporizer by direct heat exchange with the liquid cryogen; and (C) passing cooled air from the vaporizer to a power transformer to provide cooling to the power transformer.

A further aspect of the invention is:

A method for cooling a power transformer comprising:

(A) passing air into a cooling device;

(B) cooling the air within the cooling device; and (C) passing the cooled air from the cooling device to a power transformer to provide cooling to the power transformer.

Another aspect of the invention is:

Apparatus for cooling a power transformer comprising:

(A) a vaporizer having an intake and an exhaust, and having means for drawing cooling fluid into the intake of the vaporizer and for ejecting cooling fluid out from the exhaust of the vaporizer;

(B) a liquid cryogen storage vessel and means for passing liquid cryogen from the storage vessel to the vaporizer; and (C) a power transformer positioned to be contacted by cooling fluid ejected out from the exhaust of the vaporizer.

Yet another aspect of the invention is:

Apparatus for cooling a power transformer comprising:

(A) a cryogen storage vessel;

(B) a power transformer having a radiator; and (C) means for passing cryogen from the cryogen storage vessel to the power transformer, said means comprising conduit means having a cryogenic valve and having at least one spray nozzle for spraying cryogen onto the power transformer radiator.

As used herein the term "indirect heat exchange" means the bringing of entities into heat exchange relation without any physical contact or intermixing of the entities with each other.

As used herein the term "direct heat exchange" means the transfer of refrigeration through contact of cooling and heating entities.

As used herein the term "cryogen" means a fluid which, at atmospheric pressure, is a gas at a temperature of −109° F.

Figure 1:
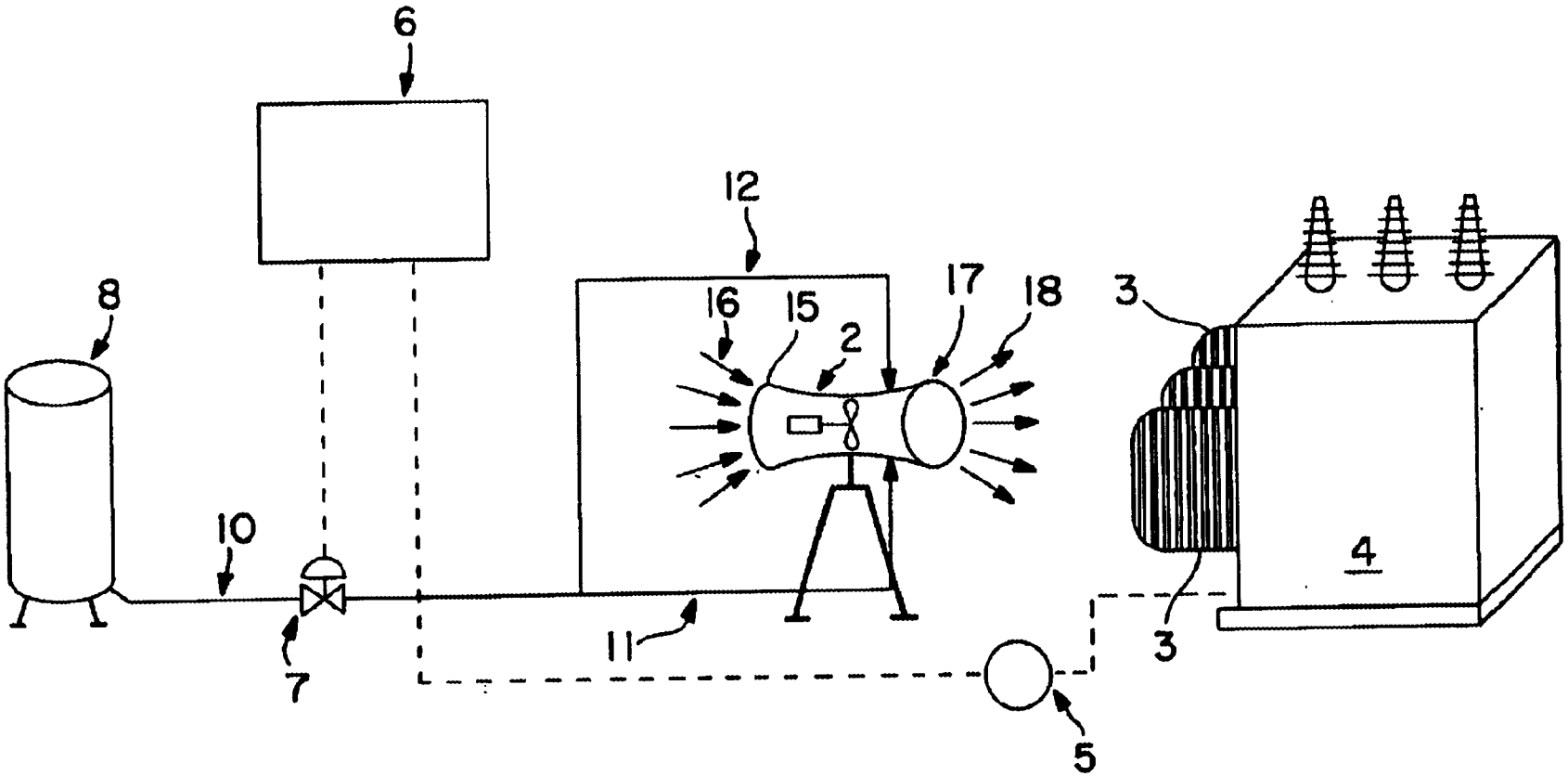
FIG. 1 is a simplified representation of one preferred embodiment of the power transformer cooling system of this invention.

The numerals in the Drawings are the same for the common elements.

DERAILED DESCRIPTION

Figure 2:
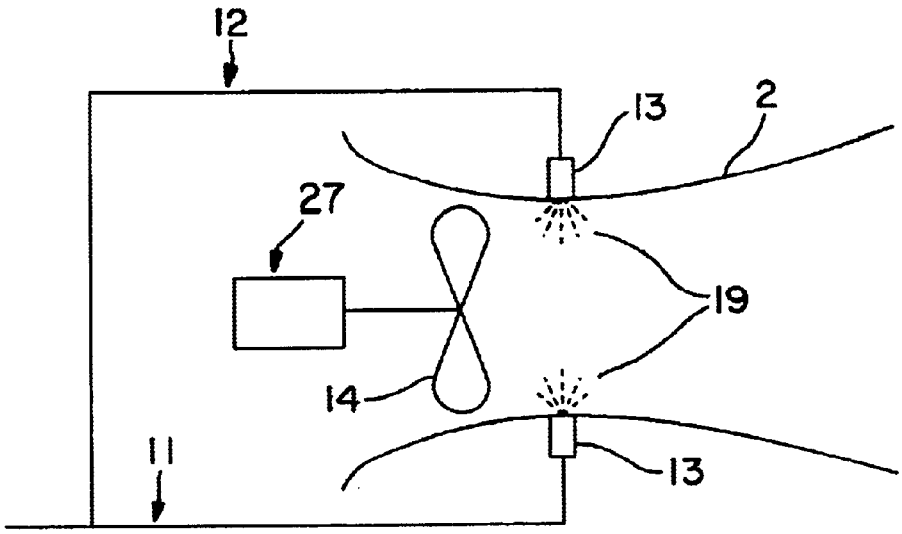
FIG. 2 is a representation of the vaporizer used in the embodiment illustrated in FIG. 1.
Figure 3:
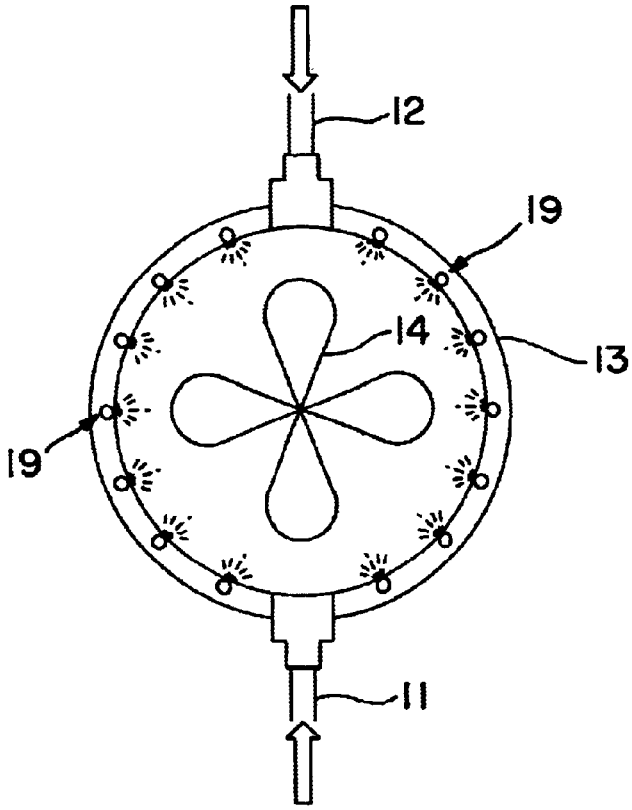
FIG. 3 is a head on or end view of the vaporizer illustrated in FIG. 2.

The invention will be described in detail with reference to the Drawings. Referring now to FIGS. 1, 2 and 3, liquid cryogen, such as liquid nitrogen, is stored in liquid cryogen storage vessel 8. Other liquid cryogens which may be used in the practice of this invention include liquid argon, liquid carbon dioxide, liquid air produced by liquefying ambient air, and other mixtures of liquid oxygen and liquid nitrogen.

Liquid cryogen is passed out from storage vessel 8 in line or conduit 10, through cryogenic valve 7 and then in lines 11 and 12 into distributor volume or sparger 13 which rings vaporizer 2.

Vaporizer or cooling device 2 has an intake and an exhaust and also has means for drawing or passing cooling fluid, e.g. ambient air, into the intake and ejecting cooling fluid out from the exhaust. the embodiment of the invention illustrated in FIGS. 1–3, this means is an electric motor 27 driving a fan 14. By operation of the electric motor and fan, ambient air is drawn into intake 15 of vaporizer 2 as shown by arrows 16, passed through vaporizer 2, and ejected out of the exhaust 17 of vaporizer 2 as shown by arrows 18. Preferably, as illustrated in FIGS. 1 and 2, vaporizer 2 has a converging/diverging configuration from the intake to the exhaust. Such a configuration serves to accelerate the cooling fluid as it passes through the vaporizer which, in turn, enhances the cooling of the cooling fluid by the heat exchange with the liquid cryogen.

A plurality of cryogenic spray nozzles 19 are positioned in distributor volume 13 for passing liquid cryogen into vaporizer 2. Preferably, as illustrated in FIGS. 1 and 2, distributor volume or sparger 13 is positioned on vaporizer 2 downstream of fan 14. By downstream it is meant between fan 14 and exhaust 17. As liquid cryogen is sprayed into vaporizer 2 from cryogenic spray nozzles 19 downstream of fan 14, the liquid cryogen contacts the cooling fluid, e.g. air, passing through vaporizer 2 and, by direct heat exchange, cools the air within vaporizer 2 as the cryogen vaporizes. The cooled air is then ejected from exhaust 17 along with the vaporized cryogen and possibly some unvaporized cryogen. Some vaporization of the cryogen and cooling of the cooling fluid may continue after the cooling fluid is ejected from the vaporizer exhaust.

Power transformer 4 having a radiator 3 is positioned such that the cooled cooling fluid ejected from vaporizer 2 contacts the radiator so as to provide cooling to the power transformer by indirect heat exchange within fluid radiator 3.

Fluid radiator 3 contains oil that continuously circulates between the radiator and the transformer. As the oil moves through the transformer, it absorbs heat energy. This heat energy is produced because the transformer is unable to transfer electrical power at 100 percent efficiency. The oil conveys this heat from the transformer to the radiator where it is rejected. The rejection of heat is necessary to prevent the internal temperature of the transformer from exceeding specifications. By cooling the oil returned to the transformer, its capacity to absorb heat is increased thereby increasing the power handling capability of the transformer.

Although the cooling fluid is illustrated in FIG. 1 as passing sideways or horizontally from the vaporizer to the radiator of the power transformer, it may be preferable to position the vaporizer so that the cooling fluid passes in an upward or in a downward direction from the vaporizer exhaust to the power transformer radiator.

The embodiment of the invention illustrated in FIG. 1 is a preferred embodiment wherein a remote control and telemetry unit 6 receives a temperature measurement 5 from the power transformer. This control and telemetry unit controls the action of cryogenic valve 7, which in turn regulates the flow of cryogen from the storage tank 8 to the vaporizer. The control and telemetry unit can communicate with a utility power dispatcher through a communication link such as a telephone circuit. The power dispatcher may use the information received from the remote telemetry unit to change the setting of the control and telemetry unit. The electrical signal means by which elements 4, 5, 6 and 7 communicate are illustrated by the dotted lines.

Figure 4:
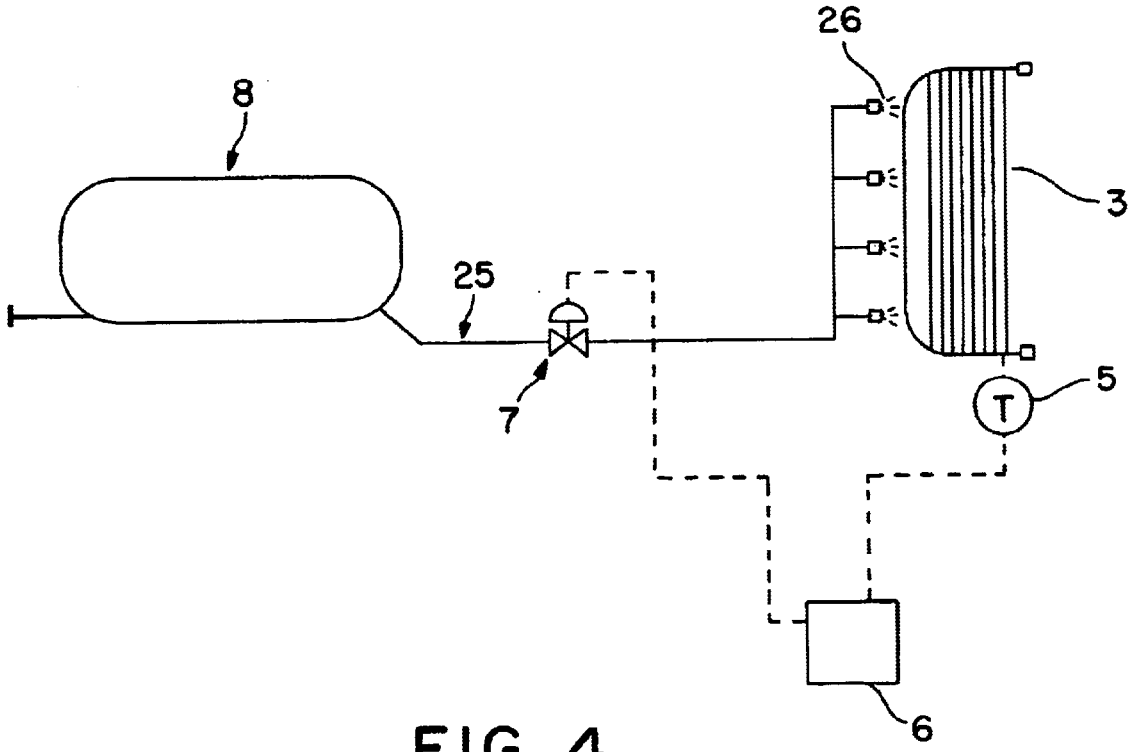
FIG. 4 is a simplified representation of another preferred embodiment of the power transformer cooling system of this invention.

FIG. 4 illustrates another embodiment of the invention wherein a separate vaporizer is not used but rather the cryogen is sprayed directly onto the surface of the power transformer radiator wherein it vaporizes or sublimates to provide cooling to the power transformer. The elements of the embodiment of the invention illustrated in FIG. 4 which are similar to those of the embodiment of the invention illustrated in FIG. 1 will not be described again in detail.

Referring now to FIG. 4, cryogen is passed from cryogen storage vessel 8 in conduit 25 through cryogenic valve 7 to plurality of spray nozzles 26 which are positioned so as to spray the cryogen onto the surface of radiator 3. The cryogen vaporizes and/or sublimates on the surface of radiator 3 thus cooling by indirect heat exchange the fluid within radiator 3 therefore cooling the power transformer.

Although the invention has been described in detail with reference to certain preferred embodiments, those skilled in the art will recognize that there are other embodiments of the invention within the spirit and the scope of the claims.

What is claimed is:

1. A method for cooling a power transformer comprising:

(A) drawing air into a vaporizer having an intake and an exhaust and having a converging/diverging configuration from the intake to the exhaust, and passing air through the vaporizer from the intake to the exhaust;

(B) passing liquid cryogen from a storage vessel to the vaporizer, spraying liquid cryogen into the vaporizer between the intake and the exhaust, and cooling air within the vaporizer by direct heat exchange with the liquid cryogen; and (C) passing cooled air from the vaporizer to a power transformer to provide cooling to the power transformer.

2. The method of claim 1 wherein the liquid cryogen comprises liquid nitrogen.

3. The method of claim 1 wherein a telemetry unit receives a temperature measurement from the power transformer and controls the action of a cryogenic valve which regulates the flow of liquid cryogen from the storage vessel to the vaporizer.

4. Apparatus for cooling a power transformer comprising:

(A) a vaporizer having an intake and an exhaust and having a converging/diverging configuration from the intake to the exhaust, and having means for drawing cooling fluid into the intake of the vaporizer and for ejecting cooling fluid out from the exhaust of the vaporizer;

(B) a liquid cryogen storage vessel and means for passing liquid cryogen from the storage vessel to the vaporizer between the intake and the exhaust; and (C) a power transformer positioned to be contacted by cooling fluid ejected out from the exhaust of the vaporizer.

5. The apparatus of claim 4 wherein the means for drawing cooling fluid into the intake of the vaporizer and for ejecting cooling fluid out from the exhaust of the vaporizer comprises electric motor and fan.

6. The apparatus of claim 5 wherein the means for passing liquid cryogen from the storage vessel to the vaporizer comprises a plurality of spray nozzles for spraying liquid cryogen into the vaporizer downstream of the fan.

7. The apparatus of claim 4 wherein the means for passing liquid cryogen from the storage vessel to the vaporizer comprises a distributor volume around the vaporizer and a plurality of spray nozzles communicating with the distributor volume and positioned to pass liquid cryogen from the distributor volume into the vaporizer.

8. The apparatus of claim 4 wherein the means for passing liquid cryogen from the storage vessel to the vaporizer includes a cryogenic valve, and further comprising a telemetry unit, means for passing a temperature measurement from the power transformer to the telemetry unit, and means for passing a signal from the telemetry unit to the cryogenic valve for controlling the operation of the cryogenic valve.

* * * * *